United States Patent [19]

Kies et al.

[11] Patent Number: 4,819,469

[45] Date of Patent: Apr. 11, 1989

[54] METHOD FOR ROLLING TAPERED THREADS ON BARS

[75] Inventors: Anton M. Kies, Oisterwijk; Harry C. van den Nieuwelaar, Gilze; Geoff M. Bowmer, Oisterwijk, all of Netherlands

[73] Assignee: Erico International Corporation, Solon, Ohio

[21] Appl. No.: 27,319

[22] Filed: Mar. 18, 1987

[51] Int. Cl.[4] ..... B21H 3/04

[52] U.S. Cl. ..... 72/89; 72/126; 72/103

[58] Field of Search ..... 72/89, 88, 126, 114, 72/103; 10/152 R, 153

[56] References Cited

U.S. PATENT DOCUMENTS

| | | | |
|---|---|---|---|
| Re. 10,932 | 5/1888 | Williams | 72/103 |
| 65,567 | 6/1867 | Harwood | 72/89 |
| 103,776 | 5/1870 | Prosser | 72/89 |
| 385,186 | 6/1888 | Kempster | 72/89 |
| 387,184 | 7/1888 | Rogers | 72/103 |
| 408,530 | 8/1889 | Rogers | 72/88 |
| 524,199 | 8/1894 | Fairbairn et al. | 72/89 |
| 859,643 | 7/1907 | Cummings | 72/103 |
| 2,666,348 | 1/1954 | Trishman | 72/103 |
| 3,717,017 | 2/1973 | Vukovich | 72/126 |

*Primary Examiner*—Daniel C. Crane

*Attorney, Agent, or Firm*—Renner, Otto, Boisselle & Sklar

[57] ABSTRACT

A machine and process for forming a high strength precision bar joint and more particularly for forming rolled tapered threads on a bar end such as the tapered end of a reinforcing bar used in concrete construction. Such machine and process employs opposed oppositely rotating die disks which have conical opposed die surfaces. A thread form die is provided on the conical die surfaces in the form of thread form spirals which bear against the opposite sides of the tapered bar surface as the die disks rotate. The die surfaces include opposed recesses into which the bar end is inserted. The bar may be held for rotation aginst a stop as the die disks oppositely rotate. Alternatively the bar end may be held against rotation and the die disks orbited around the bar end as the die disks oppositely rotate. A tapered surface is formed on the bar end prior to roll forming of such threads as by hot or cold forging or by cutting. The bar is held by a transfer vice for transfer from the tapered surface forming operation to the thread rolling operation to ensure that the tapered surface is properly centered while the threads are formed.

15 Claims, 4 Drawing Sheets

METHOD FOR ROLLING TAPERED THREADS ON BARS

DISCLOSURE

This invention relates generally to a tapered rolled thread bar joint and more particularly to a method and apparatus for rolling uniform tapered threads on bar ends.

BACKGROUND OF THE INVENTION

Tapered threads have long been recognized as superior in forming couplings for bar and tube joints, particularly where tensile capabilities are important. Such taper thread joints in bars such as reinforcing bars used in concrete construction have been widely employed, an example being the LENTON brand coupler and coupling systems sold by Erico Products Inc. of Solon, Ohio or Erico BV of Tilburg, Holland. Such bars may be of substantial diameter and in some applications quite long or even bent. To cut tapered threads on such bars requires an expensive and complex thread cutting machine. For this reason smaller more portable thread cutting machines such as shown in Kies et al U.S. Pat. No. 4,526,496 have been developed. While such machines have proven effective in being able to taper thread the end of reinforcing bar, such threads are nonetheless cut.

It has also long been recognized that roll formed threads are superior to cut threads for most ferrous materials. Advantages of thread rolling are accuracy, uniformity, improved surface finish, and most importantly better tensile, shear and fatigue properties. The cold working of the bar end during thread rolling actually strengthens the threaded bar end in the area of the threads so that it then becomes possible to produce a bar joint having tensile strength approaching or greater than that of the bar alone.

Thread rolling is conventionally accomplished in machines employing flat dies, or two or three cylindrical dies. The rolling of tapered threads presents a more complex problem. Flat dies can be used where the part being threaded is relatively small such as self tapping screws as seen for example in U.S. Pats. Nos. 3,217,530; 3,896,656; 1,946,735; 1,971,917; 2,165,009; 2,183,688; 2,232,337; 2,293,930; 2,335,418; 2,348,850; 2,483,186; 3,176,491; 4,255,969; 4,546,639 and 4,563,890.

For larger parts such as pipe, tube or rods special rolling dies may be employed as seen for example in U.S. Pats. No. 859,643; 2,666,348 and 2,932,222.

Roll threading with essentially flat dies is limited in its ability to accommodate uniform fastener taper exceeding 2°–3°, for example, when uniform pitch and thread form are required. Die speed cannot be coordinated with fastener surface speeds along the taper length during rolling. This results in twist or slip distortions between the large and small end of the tape. Slip results in stagger between the die and fastener when the part is formed. Additionally helix angles and thread tolerances are compromised. All such problems negate efficient assembly and strength development if the male threads are to be assembled with female threads prepared by a threading process which generates uniform pitch and thread form. While the flat die process may efficiently make self tapping screws, for example, it is not acceptable for producing a high strength precision bar or pipe joints.

The problem of forming rolled tapered thread on bar ends such as large bar, irregular surface bar such as concrete reinforcing bar, or earthing or electrical ground rods presents even further problems. For example rolled threads can often be more easily formed if or as the bar rotates. However if the bar is long, large or even bent this creates a problem. If the bar has irregular surfaces such as concrete reinforcing bar it is difficult to grip or position the bar so that its true centerline is located with respect to any thread forming dies.

SUMMARY OF THE INVENTION

A machine and process for forming rolled tapered threads on a bar end and more particularly the tapered end of a bar with surface irregularities such as a reinforcing bar used in concete construction comprises opposed oppositely rotating die disks which have tapered opposed die surfaces. A thread form die is provided on the tapered die surfaces in the form of thread form spirals which bear against the opposite sides of the tapered bar surface as the die disks rotate. The die surfaces include a recess into which the bar end is inserted. The bar may held for rotation against a stop as the die disks oppositely rotate. Alternatively the bar end may be held against rotation and the die disks orbited around the bar end as the die disks oppositely rotate. A tapered surface is formed on the bar end prior to roll forming of such threads as by hot or cold forging or by cutting. The bar may be held by a transfer vice for transfer from the tapered surface forming operation to the thread rolling operation to ensure that the tapered surface is properly centered while the threads are formed.

With the machine and process of the present invention a precision bar joint is provided enabling the efficient assembly and strength development with a coupling sleeve having threads having uniform pitch and thread form.

To the accomplishment of the foregoing and related ends the invention, then, comprises the features hereinafter fully described and particularly pointed out in the claims, the following description and the annexed drawings setting forth in detail cetain illustrative embodiments of the invention, these being indicative, however, of but a few of the various ways in which the principles of the invention may be employed.

DETAILED DESCRIPTION OF THE PREFERRED EMBODIMENTS

Figure 1:
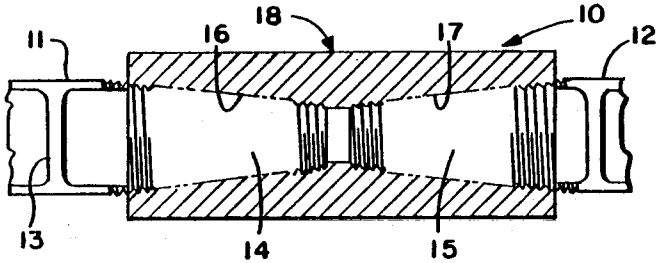
FIG. 1 is a bar joint in accordance with the present invention with the internally threaded coupling sleeve shown in section.

Referring first to FIG. 1 there is illustrated a bar joint 10 in accordance with the present invention. The bar joint includes, for example, two concrete reinforcing bars 11 and 12 which, as indicated, have surface irregularities 13. The ends of such bars are provided with tapered rolled threads on their ends as indicated at 14 and 15, respectively. Such threads are in mesh with the internal tapered threads 16 and 17, respectively, of coupling sleeve 18. The internal threads may either be rolled or cut. In the illustrated embodiment, the taper angle of the threads is about 6°.

Figure 2:
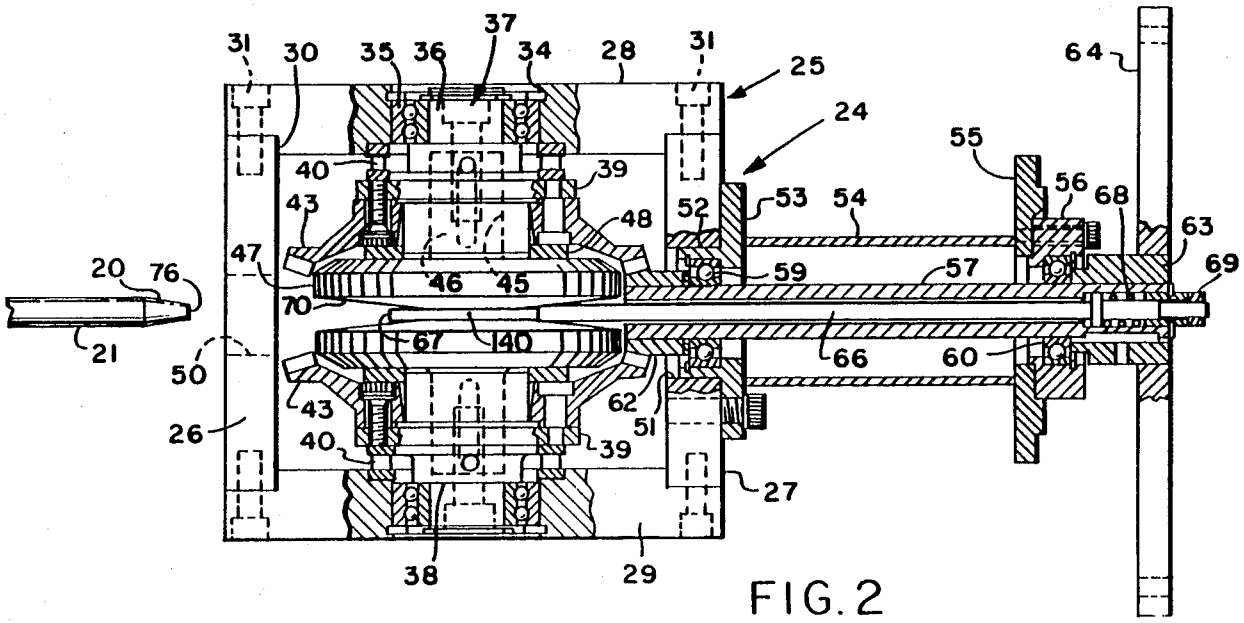
FIG. 2 is a longitudinal mostly in section reduced view of one form of machine in accordance with the present invention.

Referring now to FIG. 2 there is illustrated a machine in accordance with the present invention for forming rolled threads on the tapered or conical surface 20 of the end of bar 21. In FIG. 2 the bar end may be hot forged to form the tapered end 20. As hereinafter described, the tapered or conical surface on the bar end may be formed in a number of ways such as by cutting, cold forging, or rolling. The machine shown generally at 24 includes a rectangular frame 25 which includes end plates 26 and 27 and opposed journal plates 28 and 29 which are stepped as indicated at 30 for a shoulder fit with the end plates and which are secured to the end plates by fasteners 31.

Each of the journal plates 28 and 29 is provided with a central hole 34 receiving a bearing 35 journaling the reduced shank portion 36 of retainer cup 37. The retainer cup is shouldered against the bearing as indicated at 38 and is provided with an annular flange 39. A roller thrust bearing seen at 40 surrounds the retainer, such thrust bearing extending between the exterior of the flange 39 and the interior of the supporting frame. Secured to the flange 39 by the fasteners seen at 42 are bevel gears 43. Each cup retainer includes a receiving cup 45 for the shank 46 of conical disk thread profile dies 47. The shank 46 is provided with a keyway seen at 48 and is keyed within the cup of the retainer. Thus the bevel gears and dies rotate as a unit. An annular spacer 48 is provided between the back of the die and the face of the bevel gear.

The end wall 26 is provided with a receiving aperture or slot 50 to permit the bar end to be inserted into the machine and between the die disks. The end wall 27 includes an aperture 51 in which is inserted the cylindrical flange 52 of annular plate 53 to which is secured tubular frame extension 54, the other end of which supports annular plate 55. Removably secured to the outer plate 55 is bearing housing 56. A hollow drive shaft 57 extends through the tube and is journaled by the bearings indicated at 59 and 50 within the cylindrical flange 52 and the bearing housing 56. Secured to the inner end of the shaft 57 is a bevel gear pinion 62 in mesh with the bevel gears 43. Secured to the outer end of the shaft 57 is a hub 63 to which drive arm or plate 64 is connected. The drive arm may be rotated by a motor as hereinafter described or it may be rotated manually. Rotation of the drive shaft 57 rotates the bevel gears 43 in opposite directions and thus the die disks secured thereto. Mounted in the drive shaft 57 is a stop rod 66, the reduced tip of which indicated at 67 projects between the die disks and serves as a positioning stop for the bar 21 when inserted between the die disks. A compression spring seen at 68 may urge the tip of the stop to an adjusted position as obtained by nuts 69 between the dies.

Figure 3:
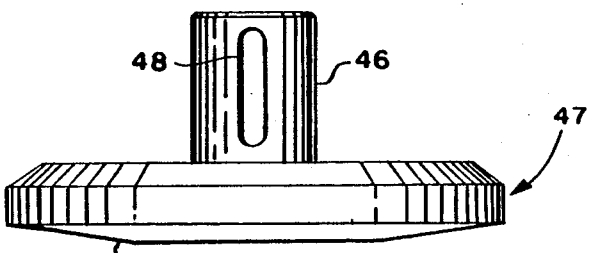
FIG. 3 is an enlarged side elevation of one of the disk dies used with the machine of the present invention.
Figure 5:
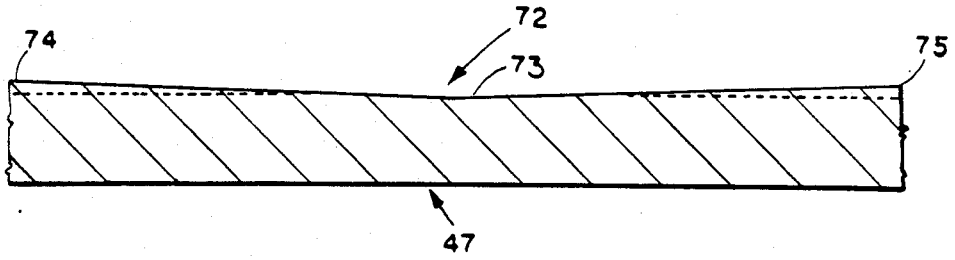
FIG. 5 is an enlarged fragmentary developed edge view of the insert recess in the die as seen from the line 5—5 of FIG. 4.
Figure 4:
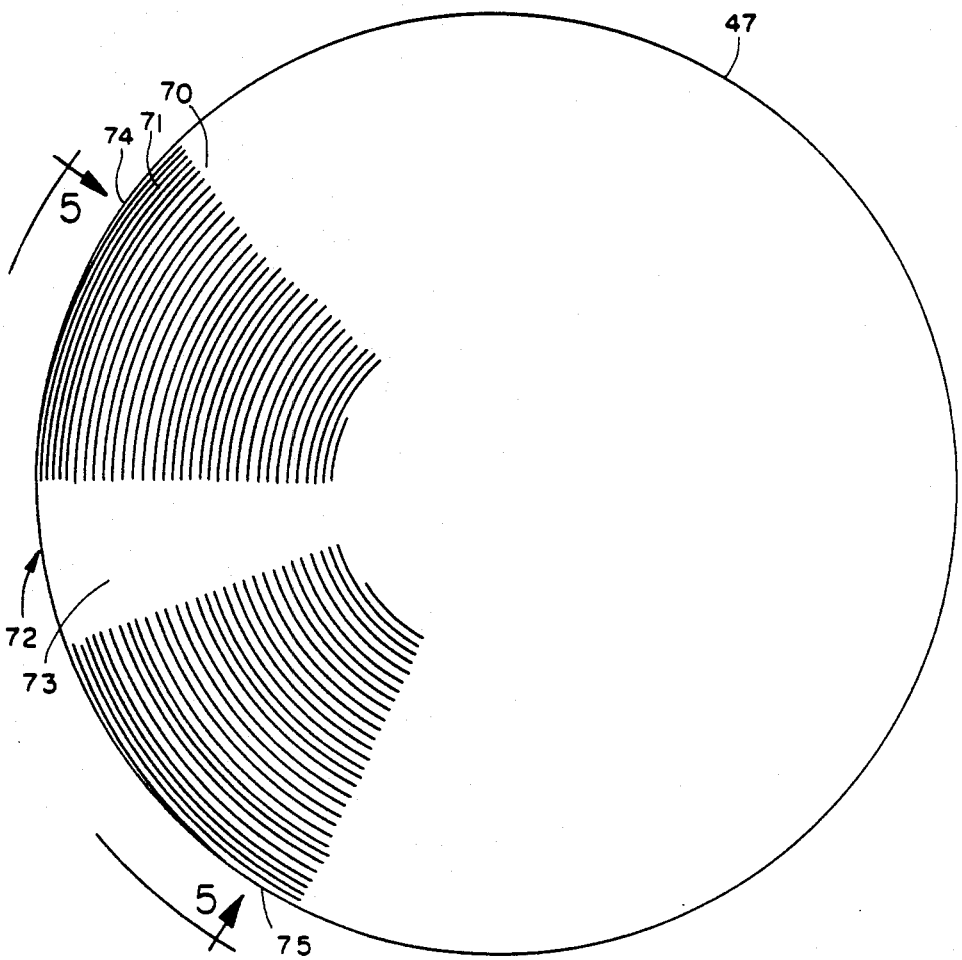
FIG. 4 is an enlarged face view of one of such dies.

Referring now to FIGS. 3, 4 and 5 it will be seen that each die disk includes a conical surface 70 provided with the desired thread profile. The thread profiles on the conical surface of the die disk are in the form of uniform inwardly directed spirals as indicated at 71 in FIG. 4. A new thread form will commence from the exterior of the die disk angularly incrementally around the die. The angular increment may be determined from the diameter of the bar and the nominal radius of the die. For example, where d is the diameter of the bar, die radius R is equal to d over two times the tangent of the taper angle of 6°. The angular displacement start points for the thread profiles around the periphery of the die then equals d over $2R \times 360°$, or about every 37°.

Each die includes a recess starting point as indicated at 72 into which the tapered bar end is inserted. The recess at its center has a depth slightly in excess of the depth of the thread profile so that in the center of the recess as indicated in FIG. 4 there is a slight area 73 having no thread profile. On each side of the recess the thread profile feathers out from a point of maximum thread profile as indicated at 74 and 75 to the center area of no thread profile 73. The recess on opposed dies are precisely aligned and permit the tip of the bar indicated at 76 in FIG. 2 to be inserted against the tip 67 of the stop. The thread profiles on the opposed conical die surfaces may be the same except that the thread profiles on one die are offset radially one-half the pitch of the thread. In this manner the tooth crest of one die disk is opposite the tooth recess of the opposed die disk.

Figure 6:
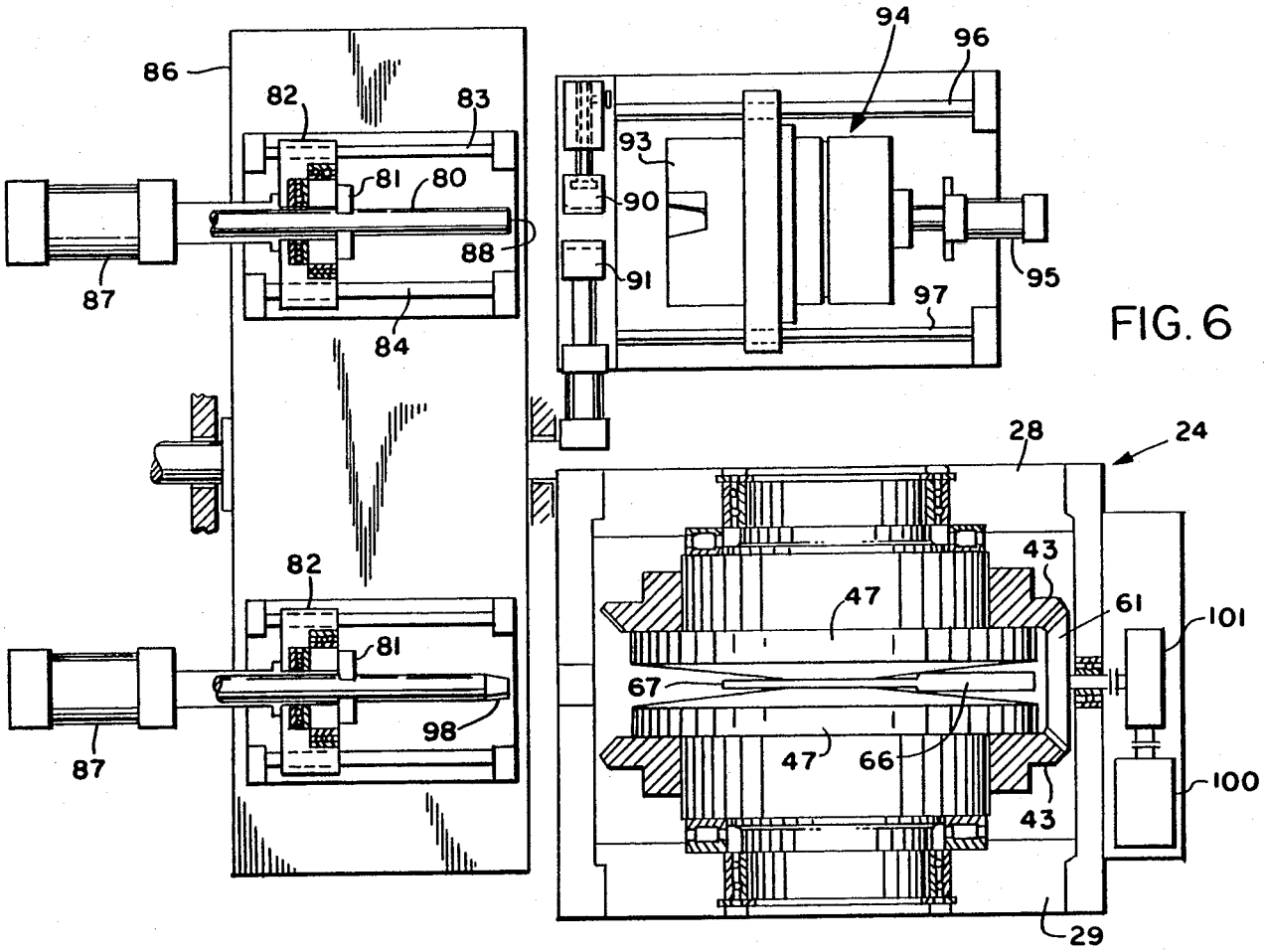
FIG. 6 is a schematic plan view of a machine in accordance with the present invention in which the bar during the thread rolling process is permitted to turn.

Referring now to FIG. 6 there is illustrated a bar 80 held by a self-centering vice 81 which is mounted on carriage 82 of indexing axially on parallel guides 83 and 84 which are mounted on transfer turntable 86. Axial movement is obtained by piston cylinder assembly 87. As illustrated, the bar 80 initially has a square or cut end 88.

Once gripped by the vice 81 the bar is indexed to the right as seen in FIG. 6 to a predetermined position and then secured by clamps 90 and 91 against rotation. At this point the rotary head 93 of cutting machine 94 is indexed to the left by piston cylinder assembly 95. The cutting machine is mounted on guides 96 and 97. While the bar end is thus held, a conical surface is formed on the bar end at the desired taper angle. The tapered surface on the bar end is shown at 98 in FIG. 6.

After the conical or tapered surface is formed on the bar end, the anti-rotation clamps 90 and 91 are released and the bar is then retracted. The transfer device 86 is then indexed to the position seen at the bottom of FIG. 6. When aligned with the thread rolling machine 24 the bar end is again axially indexed into the machine to bring the tip of the bar against the tip 67 to stop 66 within the opposed and aligned recesses.

Because the self-centering vice 81 has maintained the bar gripped from the taper cutting machine 94, the center of the cut cone will be centered in the machine 24. Drive motor 100 through transmission 101 rotates the pinion 62 which oppositely rotates the bevel gears 43. The die disks then will rotate one complete turn bringing the recesses therein back to the original opposed starting position. During this process the bar rotates because of the self-centering vice 81, such axis of rotation being the same as the center axis of the cut conical surface 98. The bar end is held against the tip of the stop 67 by the piston cylinder assembly 87 and in this embodiment the stop 66 may be fixed. After such one complete die revolution, the bar is retracted. During the thread rolling operation another bar is being provided with the conical surface 98.

Figure 7:
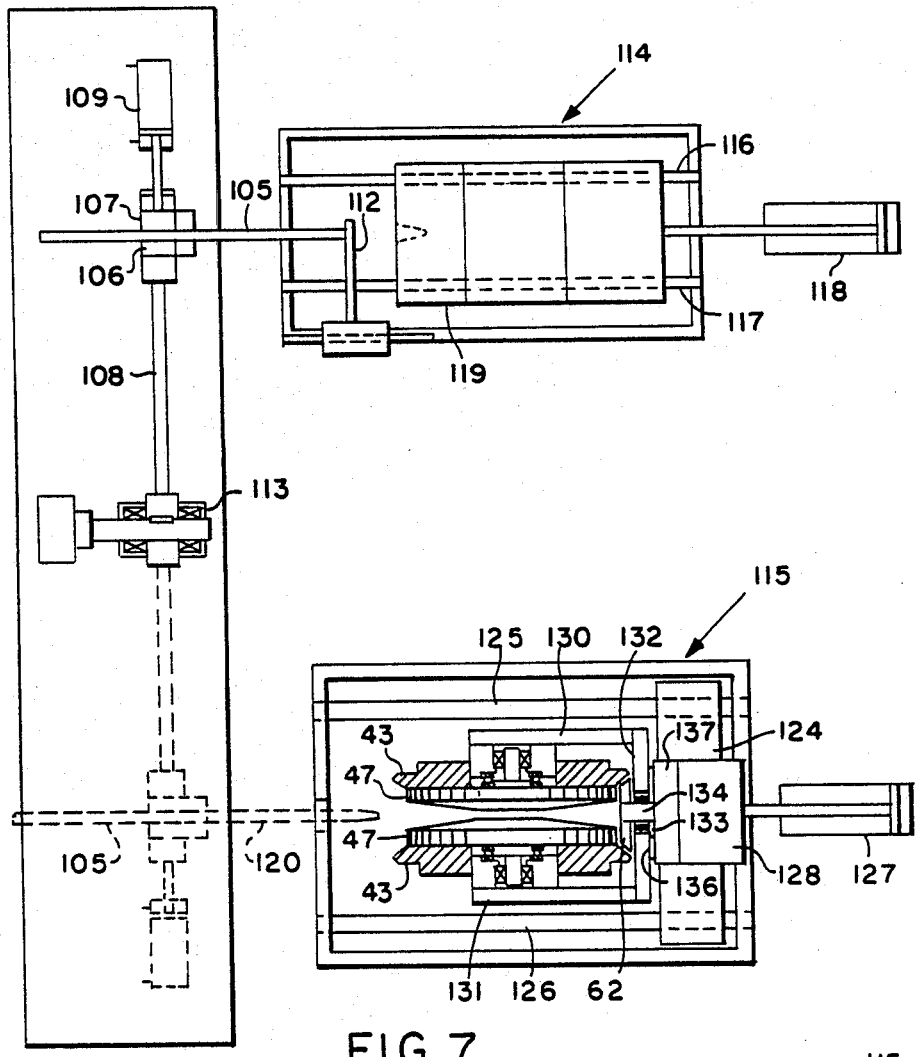
FIG. 7 is a schematic plan view of a machine similar to FIG. 6 with the bar being held against rotation.
Figure 8:
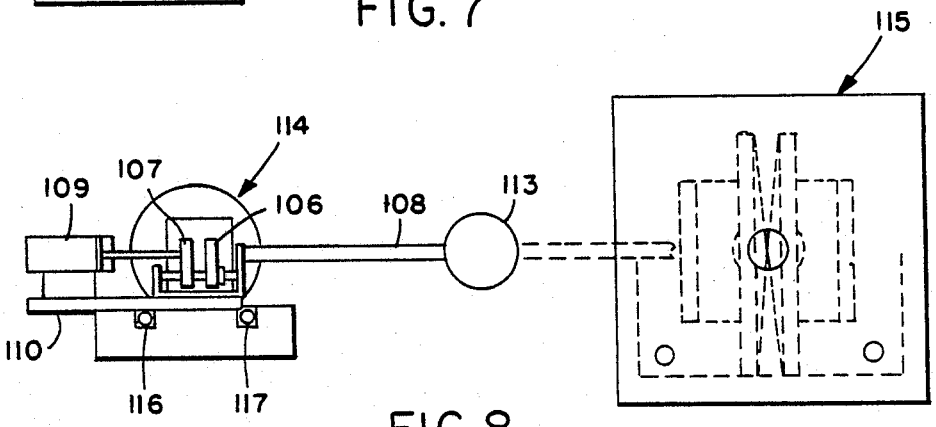
FIG. 8 is a front elevation of the machine shown in FIG. 7.

Referring now to FIGS. 7 and 8 there is illustrated a bar 105 gripped between a fixed clamping jaw 106 and a movable clamping jaw 107 on transfer device 108. The movable clamping jaw may be actuated by piston cylinder assembly 109 which is supported on extension 110 of the arm 108 (see FIG. 8). Adjustable and removable stop 112 seen in FIG. 7 may be employed to control precisely the extent of projection of the bar end from the clamp. The turntable arm 108 may be journaled as indicated at 113 to move the projecting bar end from the cutting machine shown generally at 114 to the thread rolling machine shown generally at 115.

After the bar is clamped and the adjustable stop 112 removed, the cutting machine is indexed along the guides 116 and 117 by piston cylinder assembly 118. The rotary head 119 then forms a conical or tapered surface on the bar end to the desired taper angle. After the cutter is retracted, the bar is then indexed by the turntable arm to the phantom line position seen at 120 which brings the center line of the tapered cut surface to the centerline of the thread rolling machine 115.

In this embodiment the thread rolling machine includes a housing 124 which is mounted on base guides 125 and 126 for indexing axially of the bar 105 in the bar position 120. Such indexing is obtained by piston cylinder assembly 127. As in the prior embodiments, the thread rolling machine comprises opposed die disks 47 and gears 43 the latter being in mesh with pinion 62 driven by drive 128 mounted on the housing 124. The gears 43 and die disks 47 are journaled on interconnected journal plates 130 and 131 which interconnection includes end plate 132 which is journaled as indicated at 133 on drive shaft 134 for the pinion gear 62. In this manner as the die disks are driven for opposite rotation or twisting with respect to each other, the entire frame 130, 131, 132 will obit or rotate about the axis of the shaft 134 or the fixed bar 105. Thus as such disks rotate 360°, the die disks will also rotate or oribt about the axis of the bar. The frame 130, 131, 132 may be driven for such orbiting movement by gearing system 136 from the transmission 137 of the drive system 138 or it may orbit freely. The system of FIGS. 7 and 8 will normally be utilized only where the bar is so long, cumbersome, bent, etc., as to make the rotation of the bar about the center of the cut concial surface impractical. It will also be appreciated that the apparatus or system utilizing the orbiting die disks may also be employed with the self-centering vice system wherein the bar end is permitted to rotate.

In the rotating bar embodiment, for the bar and die illustrated, the bar with a 6° taper angle will rotate slightly in excess of 9.5 times as the die disks rotate oppositely 360°. In the fixed bar embodiment the die disks would orbit 9.5 times around the fixed bar as the die disks rotate 360°.

In the illustrated embodiments, the die disks are coaxial and have a radius approximately equal to the length or height of the cone on the largest diameter bar end if it came to a point. The die radius-bar end relationship is selected so as to coordinate angular displacement along the pitch cone tangent points during rotational contact. This relationship is achieved by an arrangement which provides approximate intersection of the die and bar end axes at a common point seen at 140 in FIG. 2 that is also the apex of the pitch cones of the dies and the bar end. This synchronizes the bar-die contact speeds along the pitch cone.

It will be apparent that bars of different diameters may be threaded between the same dies as long as the taper angle is the same. Also, normally the diameter of the conical surface die required for a particular range of bar sizes is inversely proportional to the tangent of the taper angle of the tapered threads.

Although the die of FIGS. 3, 4 and 5 utilizes a single recess which serves as both the start and withdrawal position, it will be appreciated that more than a single recess may be provided and that one may be a start recess and another a withdrawal recess. A start recess need only be of a depth equal to part of a thread form height and itself could form the bar position stop. The withdrawal recess however must provide a clearance so that the finished part is freed from the dies for removal. Both such recesses may take the form of a cut away portion of the die. If the start recess and the withdrawal recess are not the same then the die will rotate less than a full turn. The degree of turn however at full thread form must be at least half the circumference of the bar at a common tangent point.

In any event there is provided a method and apparatus for rolling threads on the tapered surface of a bar end with the desired precision necessary to enable such rolled threads to be readily assembled with mating female threads of uniform pitch and thread form, whether formed by cutting or rolling, all to produce a precision bar joint having increased strength.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A method of rolling tapered threads of uniform taperangle on the end of a bar comprising the steps of providing a concrete reinforcing bar having an end, positioning such bar end between opposed circular conical surface thread dies each having an arc segment length, such that the axes of such dies intersects the axis of the bar, and then rotating the dies in opposite directions against the bar end to produce a uniformly tapered thread, whereby the bar-die contact speeds along the pitch cone of the tapered threads being formed is substantially synchronized.

2. A method as set forth in claim 1 wherein the diameter of the circular conical surface dies is inversely proportional to the tangent of the taper angle of the tapered threads.

3. A method as set forth in claim 1 wherein the arc segment length of the conical die surface at a given pitch cone tangent point with the bar end is at least as long as half the circumference of the bar pitch cone at such given tangent point.

4. A method as set forth in claim 1 wherein there are two opposed conical surface thread dies, and the axis of each die intersects the axis of the bar at a common point, and the axis of each die is the same.

5. A method as set forth in claim 1 including supporting such bar for rotation as the dies rotate thereagainst.

6. A method as set forth in claim 1 including holding such bar against rotation, and orbiting said dies around the bar as the dies rotate thereagainst.

7. A method as set forth in claim 1 including the step of first forming a conical surface on the bar end and then rolling such tapered threads on the conical surface of the bar end as aforesaid.

8. A method as set forth in claim 7 including the step of placing the apices of the pitch cones of the dies and bar end at a substantially common point.

9. A method as set forth in claim 1 including the step of providing opposed bar end insert recesses on the opposed conical surface thread dies.

10. A method as set forth in claim 9 wherein the thread form arc segment length of the conical surface thread dies excluding the recesses, at a given tangent point with the bar is at least as long as half the circumference of the bar at such given tangent point.

11. A method as set forth in claim 9 wherein each recess is formed by progressively reducing the die thread profile depth on each side thereof.

12. A method as set forth in claim 11 wherein the recess in each die has a depth at its center slightly greater than the depth of the die thread profile.

13. A method of forming a thread of uniform taper angle on the end of a reinforcing bar comprising the steps of providing a concrete reinforcing bar having a longitudinal axis and an end, forming a tapered plain surface on such bar end, and then placing such bar end between a pair of opposed die disks having uniformly tapered conical surface thread dies provided with a uniform thread profile, and then oppositely rotating such disks about axes extending transverse to said reinforcing bar axis to form a uniformly tapered thread on the tapered plain surface of the bar end.

14. A method as set forth in claim 13 including the step of permitting such bar to rotate about its axis as such disks oppositely rotate.

15. A method as set forth in claim 13 including the step of holding the bar against rotation while such disks about the axis of the bar as they oppositely rotate, and orbiting such disks about the axis of the bar as such disks oppositely rotate.

* * * * *